US008462078B2

(12) United States Patent
Murphey et al.

(10) Patent No.: US 8,462,078 B2
(45) Date of Patent: Jun. 11, 2013

(54) DEPLOYABLE SHELL WITH WRAPPED GORES

(75) Inventors: Thomas W. Murphey, Albuquerque, NM (US); Jeremy A. Banik, Albuquerque, NM (US); Whitney D. Reynolds, Albuquerque, NM (US); Laura A. Stiles, Prairie Village, KS (US)

(73) Assignee: The United States of America as Represented by the Secretary of the Air Force, Washington, DC (US)

( * ) Notice: Subject to any disclaimer, the term of this patent is extended or adjusted under 35 U.S.C. 154(b) by 287 days.

(21) Appl. No.: 12/967,814

(22) Filed: Dec. 14, 2010

(65) Prior Publication Data

US 2012/0146873 A1 Jun. 14, 2012

(51) Int. Cl.
*H01Q 15/20* (2006.01)

(52) U.S. Cl.
USPC ..... 343/915; 343/916

(58) Field of Classification Search
USPC ..... 343/912, 915, 916
See application file for complete search history.

(56) References Cited

U.S. PATENT DOCUMENTS

| | | | | |
|---|---|---|---|---|
| 3,064,534 | A * | 11/1962 | Tumavicus | 359/853 |
| 3,699,576 | A * | 10/1972 | Hoyer | 342/10 |
| 5,198,832 | A * | 3/1993 | Higgins et al. | 343/915 |
| 6,930,654 | B2 * | 8/2005 | Schmid et al. | 343/915 |
| 7,859,479 | B2 * | 12/2010 | Legare et al. | 343/882 |

* cited by examiner

*Primary Examiner* — Tan Ho
(74) *Attorney, Agent, or Firm* — James M. Skorich

(57) ABSTRACT

A reflector useful for communications, radar and sensing application in space and on earth includes thin shell gores emanating from a geometric center of the reflector at its hub. Gores are provided in a spiraled pattern and are in elastic connection to said hub and wrapped around their point of convergence at the hub when the reflector is stowed. The gores emanate from the geometric center of the reflector hub at their elastic connection to the hub when they are deployed and operational as a reflector with a point of convergence to promote operation as a reflector. Thin shell gores can have an inner perimeter and outer perimeter, can be provided in a spiraled pattern, and can be interlocked at their outer perimeter, or in-between their inner and outer perimeter, while also remaining in elastic connection at their inner perimeter to said hub.

2 Claims, 5 Drawing Sheets

Overhead view of a deployed parabolic reflector antenna subdivided into gores with an outer edge connection mechanism

Overhead view of a deployed parabolic reflector antenna subdivided into gores with an outer edge connection mechanism Oblique view Side view 3A 3B Top view – first stage of stowing Oblique view – first stage of stowing Top view – second stage of stowing Oblique view – second stage of stowing Top view Oblique view – stowed configuration of parabolic dish. Gores form the vertical sides

Flexible Connecting Bands Located Within The Reflector Antenna

DEPLOYABLE SHELL WITH WRAPPED GORES

STATEMENT OF GOVERNMENT INTEREST

The conditions under which this invention was made are such as to entitle the Government of the United States under paragraph 1(a) of Executive Order 10096, as represented by the Secretary of the Air Force, to the entire right, title and interest therein, including foreign rights.

BACKGROUND OF THE INVENTION

The invention relates generally to the packaging of small deployable reflector antennas, and in particular to reflector antennas that can be packaged within CubeSat dimensions.

The process of launching satellites from earth's surface into space subjects them to gravity and additional acceleration and aerodynamic loads from the launch vehicle. These loads create large stresses in any spacecraft components not uniformly supported by the launch vehicle and bus structures. To allow large components to be adequately supported and aerodynamically shielded by the launch fairing, they are often collapsed to a smaller configuration. Once in space, the components are deployed into their larger operational configurations. Reflector antennas, an application of the current invention, are often many times larger than the launch vehicle fairing and must be compactly packaged for launch and unfurled once in orbit. Such reflectors are used for space communications, radar and other radio frequency missions.

Greschik proposed a deployment concept for a parabolic reflector in which incisions were made in a flexible shell surface of a parabola to transform the doubly curved surface into a quasi-foldable mechanism (G. Greschik, "The Unfolding Deployment of a Shell Parabolic Reflector," 1995, AIAA-95-1278-CP). However, this achieved poor packaging in either the radial or height directions. Tibbalds devised a new way of optimizing the folding scheme to improve on packaging (B. Tibbalds, S. D. Guest and S. Pellegrino, "Folding Concept for Flexible Surface Reflectors." 1998 and B. Tibbalds, S. D. Guest an S. Pellegrino, "Inextensional Packaging of Thin Shell Slit Reflectors" Technische Mechanik, 2004). A solid surface reflector is cut into spiral gores that fit together in a cylindrical manner about a central hub when packaged resembling a flower. The gores synchronously open out and unwrap during deployment with their edges pulled together by springs or other devices. No structural method is disclosed, however, to link the gores together once deployed. If flexible solid surface reflectors could be compressed into a smaller package and a means to hold their edges together once deployed were developed, these concepts should become commercially successful for space applications. This is the intent of the present invention.

SUMMARY

An elastically deployable thin shell, nominally in the shape of a hemisphere or paraboloid is described. The invention is composed of thin shell gores radiating from the geometric center of the shape in a spiral pattern. Gores are specially shaped to elastically wrap around the point of convergence of the gores. Performing this wrapping operation reconfigures the shape from the deployed and operational configuration to a much smaller packaged configuration for transportation. Gores are structurally connected by a flexible mechanism. This mechanism looks and behaves similar to a pantograph mechanism and can be placed at multiple locations to structurally connect two gores.

DESCRIPTION OF THE PREFERRED EMBODIMENT

A deployable parabolic or hemispherical shell is disclosed that compactly packages for launch and transportation and autonomously deploys to a much larger operational configuration. The invention uses stored elastic strain energy to power the deployment. External power is used only to activate release devices. Packaging is accomplished by cutting the shell in a spiral-like pattern of slender gores that compactly wrap around the center of the shell. The invention improves upon prior art by achieving greater compaction at a lower cost than previous designs and greater rigidity when deployed.

Figure 1A:
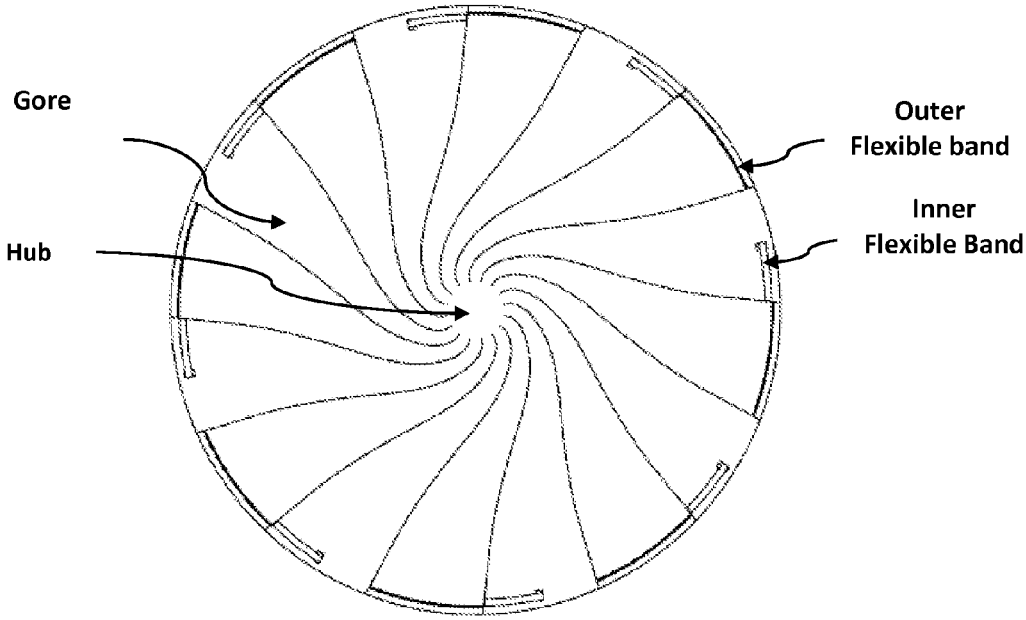
FIG. 1 shows a top (1A), oblique (1B) and side (1C) view of a fully deployed parabolic reflector segmented into gores and having an outer edge stabilizing ring of flexible bands.
Figure 1B:
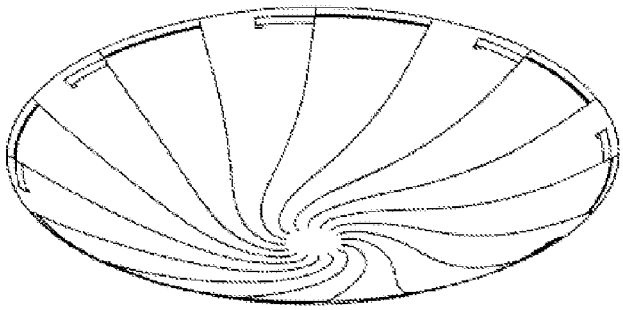
Figure 1C:
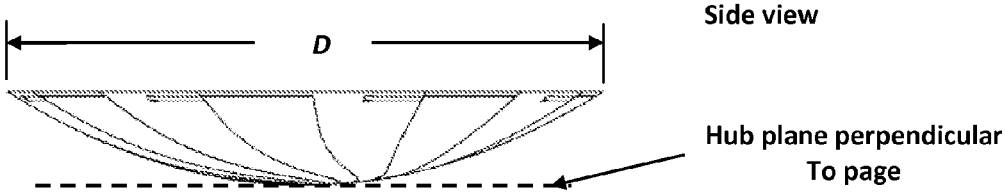
Figure 2:
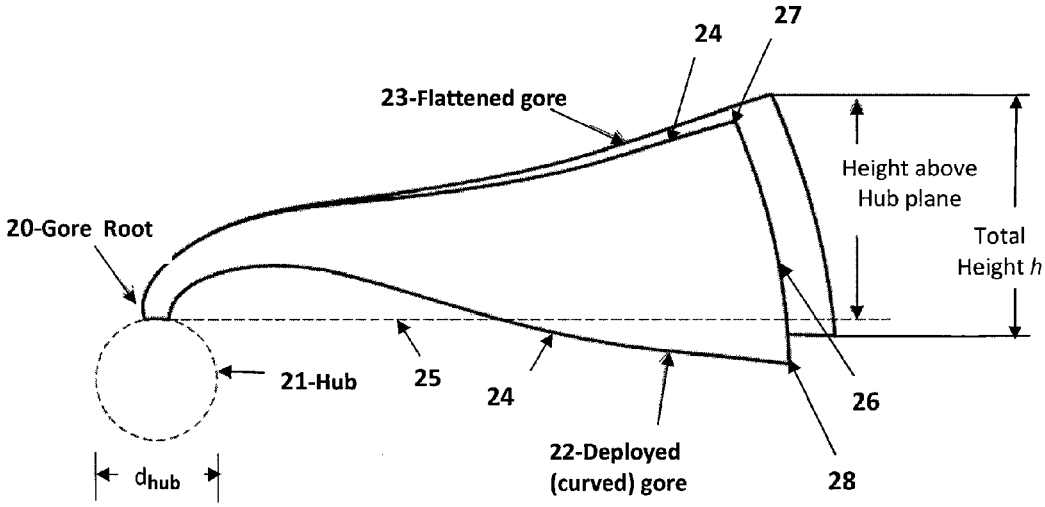
FIG. 2 shows a top view of a deployed and a flat gore shape indicating stowed height considerations.

FIG. 1 shows overhead (1A), oblique (1B, and side (1C) views of a parabolic reflector antenna of deployed diameter D showing the gore pattern and a flexible band similar to a pantograph mechanism located along the outer edge of the gores that structurally connects the gores together. The spiral gore pattern of the current invention is modified from previous concepts to minimize the packaged volume and maximize the shell bend radius while packaged. Shell materials fail at small bend radii and maximizing this allows more structurally efficient materials to be used. FIG. 2 shows the different elements of a single gore in top view. The gore root 20 is the point where the gore is attached to the hub 21. The full deployed gore 22 is shown as it would appear as part of a parabolic dish from overhead and how it would appear if laid out on a flat surface 23. A full set of such gores in deployment would have the side edges 24 touching adjacent gores. A mandrel with a desired curvature may be used to form the dish with carbon fiber/epoxy, for example. A variety of composite materials could be used, with the material being cut out in the gore shapes obtained from the flat configuration, and laid up on the mandrel with edges 24 touching adjacent gores. The outer edge strip (not shown) could either be laid up before curing or glued on after the curing process. Other resilient materials that may be used include beryllium copper, stainless steel, carbon reinforced plastic, glass reinforced plastic, and Kevlar reinforced plastic.

Figure 3:
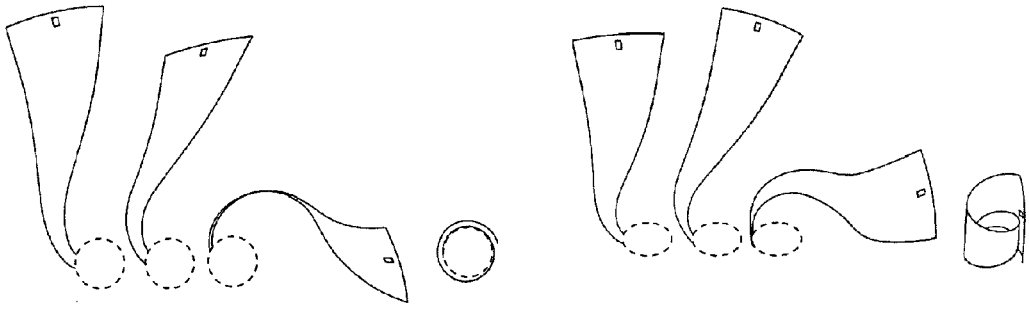
FIG. 3 shows the stowing sequence for a single gore from the perspective of a top view (3A) and an oblique view (3B).

The gore design is driven by the final specified packing size. For a CubeSat that would be a volume of one liter or a cube of 0.1 meter dimensions. Given design constraints of a parabolic dish of diameter D, and cylindrical packing requirements of height h and diameter d, with a given hub position within the cylinder, the gore shape is determined as follows. FIG. 2 shows geometry details relating to the final stowed height of the reflector. The difference between the deployed and curved states is due to the flattening of the curved surface to facilitate manufacturing (in the case of a composite layup), or to visualize the wrapped configuration. The hub 21 is drawn as a dashed circle, but is actually a polygon with the number of sides equal to the number of gores and having a diameter $d_{hub}$. There is always an even number of gores. The horizontal (dashed) line 25 extending from a polygon segment of the hub remains stationary as the gore 22 is folded up (out of the plane of the paper at the gore root) and wrapped around the hub, ending perpendicular to the plane of the hub. The gores are packaged to form a cylinder perpendicular to the hub plane of height h and diameter d (as in FIGS. 3A and 3B). The position of the outer edge of the gore 26 relative to the dashed line 25 may vary half way between the upper 27 and lower 28 corners adjacent to the lower corner depending on the shape of the gore. This allows space for an antenna feed above the hub in the packaged configuration.

The height of the flattened gore h determines the total height of the packaged cylinder. In order to fit a parabolic dish of a specific deployed diameter D into the cylindrical package constraint d, the dish needs to have enough gores to reduce the packaged height h to be within the constraint. The hub diameter must be small enough to allow for wrapping of material around the hub, while remaining within the cylindrical diameter constraint d. The shape of the gore root is important in determining where and how easily the gore will make the necessary bend to set the wrapping about a vertical axis. It is most effective to make the gore root depart the hub radially, and to configure the geometry so that this is the narrowest section of the gore.

Proper gore design results in a configuration in which the design constraints are met by establishing the proper number of gores, the outer edge positioning, the outer edge intersection angle, and the gore root geometry. The final result is a deployable reflector that packages very small while allowing for self deployment.

There are a number of considerations for determining the gore shape. Shape of the gore root. The root of the gore (see FIG. 2) is determined by two things: making the gore narrow at the desired fold location 20, and making the edges of the gore perpendicular to the point of the fold so that the gore tends to bend in the desired direction.

Outer edge location. The position of the outer edges of the gore 27, 28 is determined by several factors: the desired height of the folded gore above the hub plane, and the total height of the stowed reflector.

Figure 4:
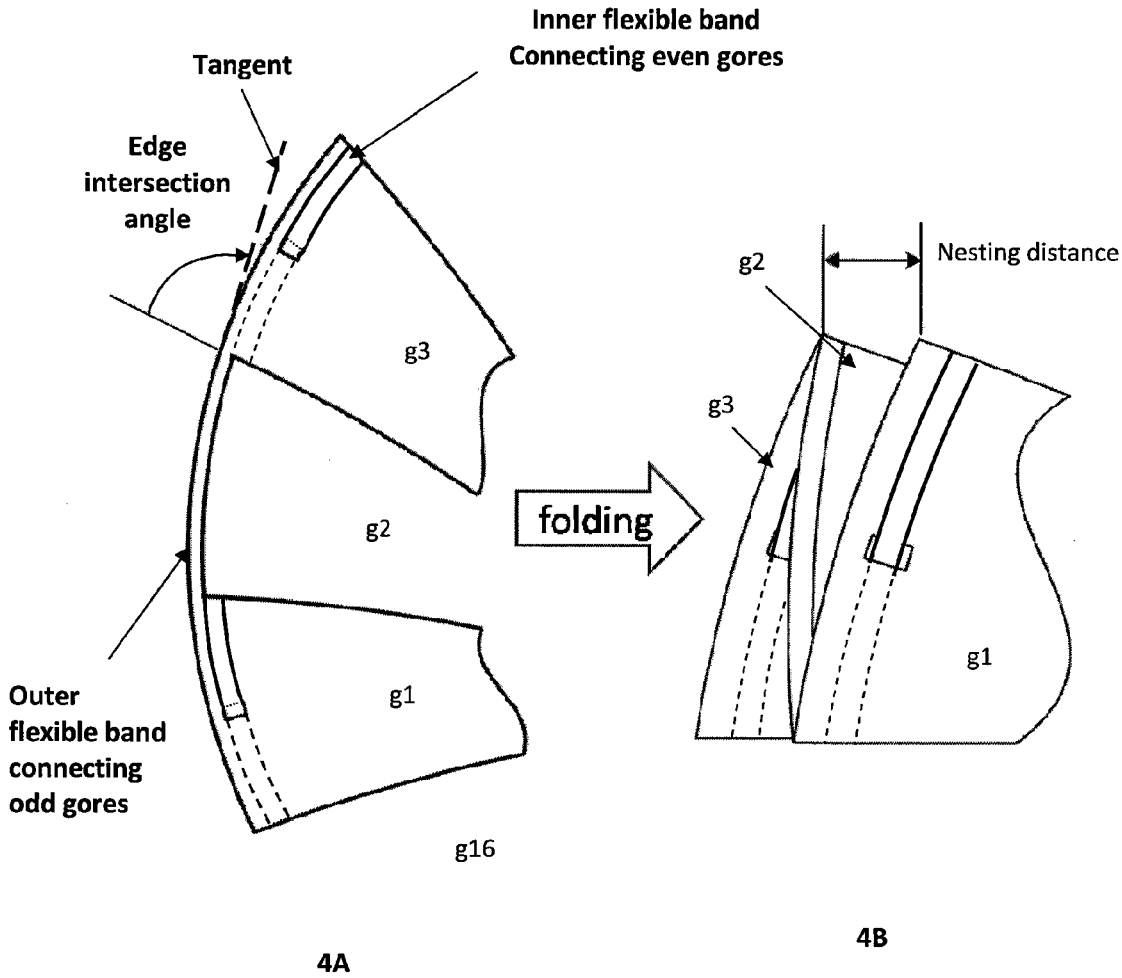
FIG. 4 shows how the outer edge intersection angle (4A) for three gores that produces a nesting distance when folded for stowing (4B).

Outer edge tangency intersection angle. The angle that the gore intersects the outer diameter is coupled with the final achievable stowed diameter. This is because the tightly concentrated bend in the outer connecting strip determines the relative indexing of the gores, which are then wrapped around the center hub. This angle can be seen in FIG. 4A as the edge intersection angle.

As shown in FIG. 4A, an outer flexible band connects the odd numbered gores and provides rigidity to the deployed dish. The even numbered gores are shorter than the odd gores by at least the width of the flexible band. The even gores are connected to each other by an inner flexible band that passes through a slot in the odd gores. The flexible band initially passes under an odd gore, as viewed from the top, and passes through the odd gore slot connect to the next even numbered gore. The dish must be cut into an even number of gores. As each gore wraps around the hub in going from a deployed to a stowed configuration, the interconnecting flexible edge strip begins to make a Z-fold. In order to facilitate the wrapping down to the proper diameter, the angle of intersection between the gore and the outer edge must be set carefully, as it controls the nesting distance of the gores. This nesting is shown in FIG. 4B. Although it is only shown for one of the outer edge strips, the others follow the same constraints, with the connecting strip passing through the hole in the gores as shown.

Figure 5A:
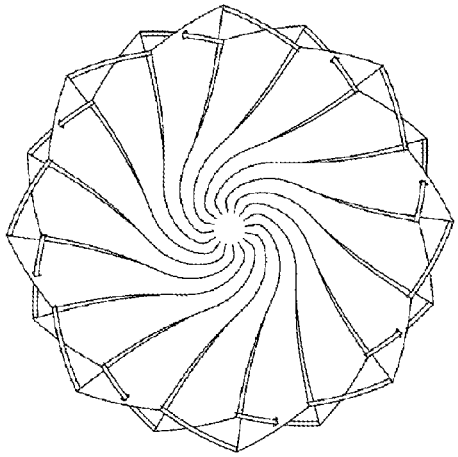
FIG. 5 shows the first stage of stowing a deployed parabolic reflector in a top view (5A) and an oblique view (5B).
Figure 5B:
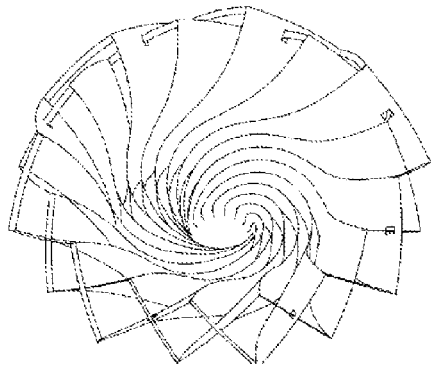
Figure 6A:
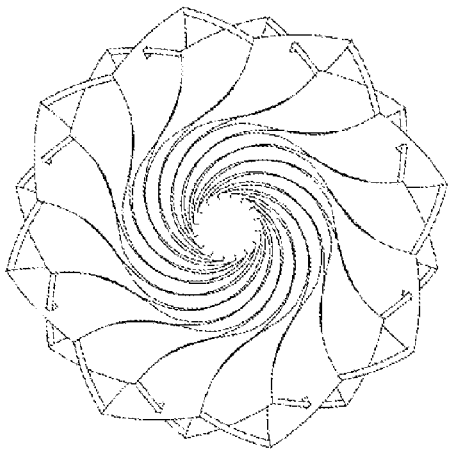
FIG. 6 illustrates a second stage of stowing a deployed parabolic reflector in a top view (6A) and an oblique view (6B).
Figure 6B:
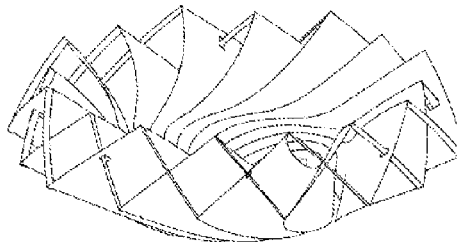
Figure 7A:
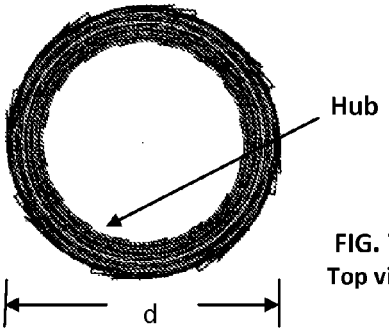
FIG. 7 shows the fully stowed parabolic reflector in a top view (7A) and in an oblique view (7B).
Figure 7B:
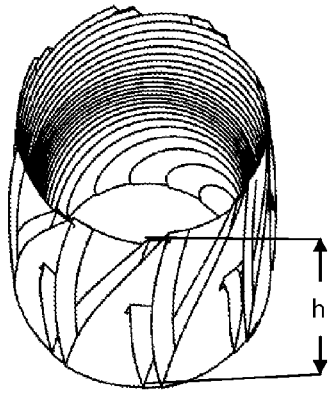

As the deployed structure is stowed, the gores rotate into a vertical orientation and wrap around the central hub. The stages of this stowing are shown in FIGS. 5-7 giving both top (A) and oblique (B) views.

Figure 8:
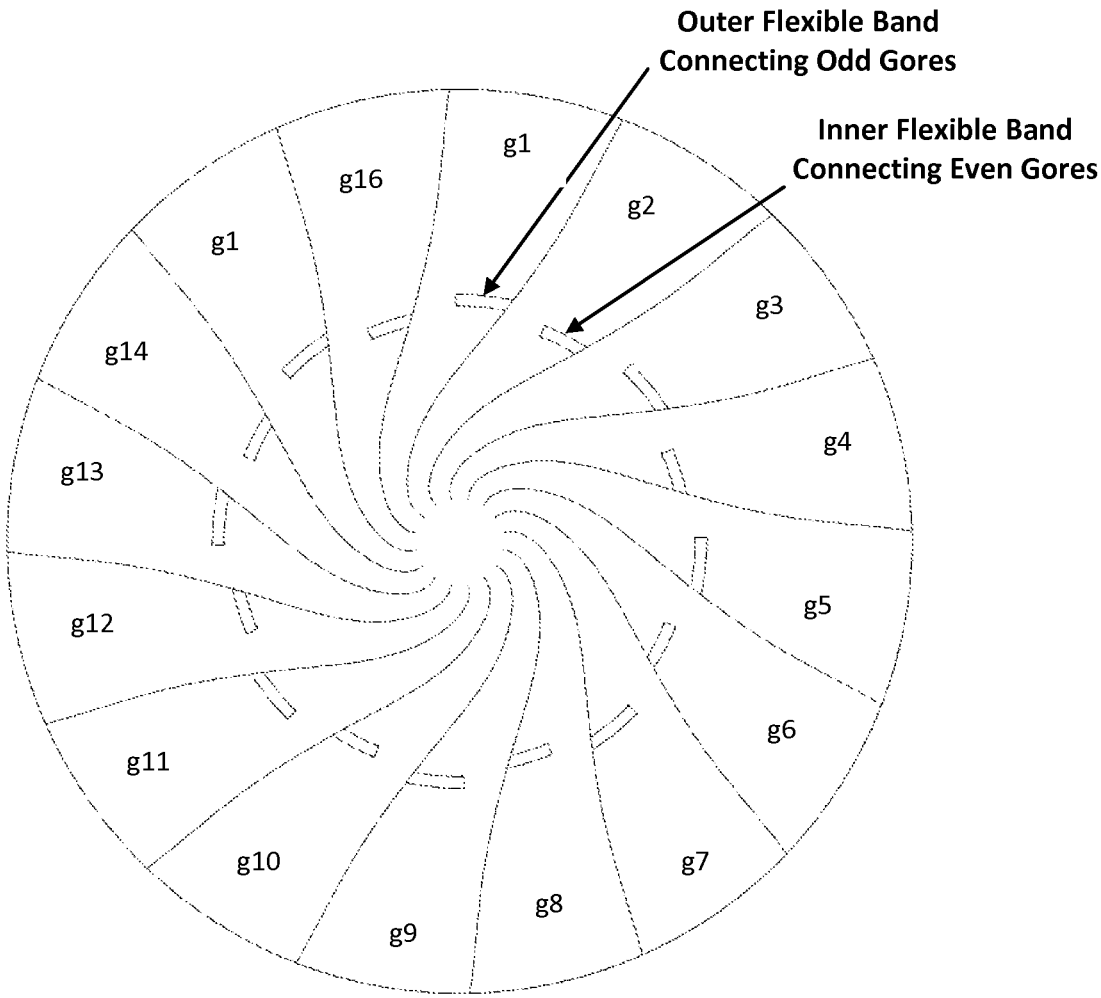
FIG. 8 is an example of a reflector antenna with flexible connecting bands located within the antenna.

The flexible bands shown located at the outer edges of the gores in FIG. 1 could instead be located closer in toward the hub as, for example in FIG. 8. This would require slots in each gore and connecting bands similar to the odd bands in FIG. 4. This set of bands could be used in addition to or instead of the outer connecting bands.

The invention claimed is:

1. A reflector, comprising:

a geometric center and a hub concentric with the geometric center;

an even number of thin elastic shell gores forming a spiral pattern having an inner perimeter and an outer perimeter;

the shell gores being elastically connected to the hub along the inner perimeter and being interlocked along the outer perimeter to form a weaved pattern around the outer perimeter;

the shell gores forming a cylinder having a longitudinal axis intersecting the geometric center when the reflector is collapsed; and the shell gores radiating centrifugally from the hub when the reflector is deployed, whereby a solid reflector surface is obtained when the reflector is deployed for operation, and the reflector can be compressed into a smaller configuration for storage and transportation.

2. A reflector, comprising:

a geometric center and a huh concentric with the geometric center;

an even number of thin elastic shell gores forming a spiral pattern haying an inner perimeter and an outer perimeter;

the shell gores being elastically connected to the hub along the inner perimeter and being interlocked along the outer perimeter;

a woven pantograph pattern being formed between the inner perimeter and the outer perimeter;

the shell gores forming a cylinder having a longitudinal axis intersecting the geometric center when the reflector is stowed; and the shell gores radiating centrifugally from the hub when the reflector is deployed, whereby a solid reflector surface is obtained When the reflector is deployed for operation, and the reflector can be compressed into a smaller configuration for storage and transportation.

* * * * *